US006260624B1

(12) United States Patent
Pallini, Jr. et al.

(10) Patent No.: US 6,260,624 B1
(45) Date of Patent: Jul. 17, 2001

(54) INTERNAL PRODUCTION RISER PRIMARY TIEBACK

(75) Inventors: Joseph William Pallini, Jr., Tomball; Jerry Keith Rhodes, Conroe, both of TX (US)

(73) Assignee: ABB Vetco Gray, Inc., Houston, TX (US)

( * ) Notice: Subject to any disclaimer, the term of this patent is extended or adjusted under 35 U.S.C. 154(b) by 0 days.

(21) Appl. No.: 09/346,871

(22) Filed: Jul. 2, 1999

Related U.S. Application Data

(60) Provisional application No. 60/095,578, filed on Aug. 6, 1998.

(51) Int. Cl.[7] ..... E21B 33/035; E21B 43/01

(52) U.S. Cl. ..... 166/345; 166/365

(58) Field of Search ..... 164/345, 348, 164/359, 365; 285/18, 920, 101

(56) References Cited

U.S. PATENT DOCUMENTS

| | | | |
|---|---|---|---|
| 3,163,223 | 12/1964 | Bauer et al. . | |
| 3,933,202 | 1/1976 | Ahlstone . | |
| 4,456,070 | 6/1984 | Watkins . | |
| 4,976,458 | 12/1990 | Hosie et al. . | |
| 5,222,560 | 6/1993 | Brammer et al. . | |
| 5,259,459 | 11/1993 | Valka . | |
| 5,279,369 * | 1/1994 | Brammer | 166/368 |
| 5,299,642 | 4/1994 | Nelson et al. . | |
| 5,566,761 | 10/1996 | Pallini, Jr. et al. . | |
| 5,775,427 * | 7/1998 | Skeels et al. | 166/344 |
| 6,035,938 * | 3/2000 | Watkins | 166/345 |

FOREIGN PATENT DOCUMENTS

| | | |
|---|---|---|
| 2091367A | 7/1982 | (GB) . |
| 2319317A | 5/1998 | (GB) . |

* cited by examiner

*Primary Examiner*—David Bagnell
*Assistant Examiner*—Jennifer R. Dougherty
(74) *Attorney, Agent, or Firm*—James E. Bradley; Bracewell & Patterson, L.L.P.

(57) ABSTRACT

An internal tieback connector for connecting a riser from a platform to a subsea wellhead having internal grooves and a casing hanger therein. The connector has an inner body which carries a lower housing adapted to land on the wellhead. A plurality of dogs abut the lower housing and are adapted to engage and lift the inner body relative to the lower housing. An upper housing is carried on the inner body and adapted to force the dogs inward into engagement with the inner body. A plurality of latch members are carried on the inner body and are adapted to engage the internal grooves when the internal is moved upward relative to the lower housing.

17 Claims, 3 Drawing Sheets

INTERNAL PRODUCTION RISER PRIMARY TIEBACK

CROSS-REFERENCE TO RELATED APPLICATIONS

This application claims the benefit of provisional application Ser. No. 60/095,578, filed on Aug. 6, 1998, in the U.S. Patent & Trademark Office.

TECHNICAL FIELD

This invention involves a riser tieback connector. More specifically, this invention is a hydraulically operated connector for tying back a riser from a platform to a subsea wellhead.

BACKGROUND ART

One type of subsea well employs a wellhead housing located at the sea floor and a drilling blowout preventer or production Christmas tree located at the surface on a platform. Large diameter casing will be lowered from the platform and connected to the wellhead housing with a tieback connector. The tieback connector must withstand various loading conditions it may see during extended periods of operation. Particularly with a tensioned leg or spar platform where the upper end of the riser is permitted to move horizontally, a bending moment is produced at the wellhead. This may occur even with a fixed platform where there is significant current force acting on the riser. The connection to the wellhead must also be capable of carrying substantial vertical force either in compression, where insufficient load is carried by the platform, or in tension, where excessive load is carried by the platform. Thermal expansion of the riser and wellhead also occurs dependant on whether the well is producing and the temperature of the fluid being produced. Furthermore, the riser must endure these stresses through many cycles over many years.

One type of connector has a downward facing funnel that slides over the wellhead housing. It has a body with an internal connector device with dogs that engage grooves formed in the wellhead housing. The connector is pre-loaded on the wellhead housing by forcing the dogs into the grooves and requires a high actuation force to achieve a high pre-load. The dogs resist all compressive and tensile loads transmitted from the riser into the wellhead. These connectors provide high load and separation capacity, but have a large outside diameter. In many cases, a reduced diameter is desired, such as for use in a spar platform.

While designs similar to this have gained acceptance, improvements are desirable in increasing static strength and pre-load capacity to increase the connector's resistance to separation loads.

SUMMARY OF THE INVENTION

The present invention is directed toward an internal tieback connector that uses hydraulics to provide a high pre-load while maintaining a near flush outer diameter. The connector is for tying back a riser from a platform to a subsea wellhead housing. The wellhead housing has a bore with an internal groove thereon. The connector has an inner body adapted to be secured to the riser or to be integral with it. There is an external profile on the inner body and a load shoulder spaced below. A housing is moveably carried on the inner body for landing on the wellhead. An upper lock member is carried by the housing. The upper lock member is inwardly, radially moveable to engage the profile on the inner body. The profile is configured to move the inner body upward relative to the housing when engaged by the upper lock member. A cam sleeve is carried on the inner body for axial movement relative to the inner body forcing the upper lock member inward into engagement with the profile on the inner body. A latch member with a load transferring portion is carried on the inner body in sliding engagement with the load shoulder. The load transfer portion of the latch member is adapted to move radially outward and engage the internal groove in the wellhead when the inner body and the load shoulder are moved upward relative to the housing.

Preferably, the connector further comprises a piston member which cooperates with the cam sleeve to define a hydraulic fluid chamber. The chamber is adapted to receive hydraulic fluid pressure to stroke the cam sleeve axially. The external profile is preferably a downward facing inclined shoulder. It is preferred that the lock member be a plurality of dogs. It is also preferred that the housing have substantially the same outer diameter as the wellhead housing and land on a rim of the wellhead housing. Preferably the latch member is a plurality of segmented fingers. Each finger has a finger extending upwardly from the load transfer portion. The finger has an outer protruding portion on an upper end that engages a recess in the housing. The finger has an inner surface that is engaged by the inner body when the inner body has moved upward to an upper position. The lock member has a surface which bears downwardly on the housing as the cam sleeve moves axially to exert a pre-load force on the wellhead by pushing the housing down on top of the wellhead while pulling up on the inner housing.

The invention is also directed toward a method of tying back a riser from a platform to a subsea wellhead where the wellhead has a bore with an internal groove. Provide a connector with an inner body, a housing axially moveably carried on the inner body, and a latch member mounted for axial sliding movement on an inclined load shoulder on the inner body. Connect the inner body to the riser and lower the connector onto the wellhead such that the inner body extends into the bore and the housing lands on the wellhead. Move the inner body upward relative to the housing to an upper position while restraining upward movement of the latch member causing the latch member to slide radially outward on the load shoulder and engage the groove in the wellhead, thus preventing further upward movement of the inner body while applying a downward force on the housing against the wellhead and locking the inner body in the upper position.

Preferably the inner body is moved upward and downward force is applied on the housing with hydraulic pressure in a chamber between the inner body and the housing. It is also preferable that the locking comprises pushing a lock member carried by the housing radially inward into a profile on the inner body. The lock member is pushed radially inward by moving a cam sleeve axially.

A connector for tying back a riser from a platform to a subsea wellhead housing. The housing has a bore with an internal groove thereon. The connector has an inner body adapted to be secured to the riser. A housing is carried on the inner body for landing on the wellhead. The inner body is axially moveable relative to the housing, to an upper position. A latch member is carried by the inner body and wedges between the inner body and the wellhead when the inner body is moved to the upper position. A lock member, for holding the inner body in an upper position, wedges between the inner body and the housing when the inner body moves up. A cam sleeve carried on the inner body is used to wedge the lock member between the inner body and the housing.

A stinger on the lower end of the inner body is adapted to engage a bowl of a casing hanger in the wellhead.

BEST MODE FOR CARRYING OUT THE INVENTION

Figure 1:
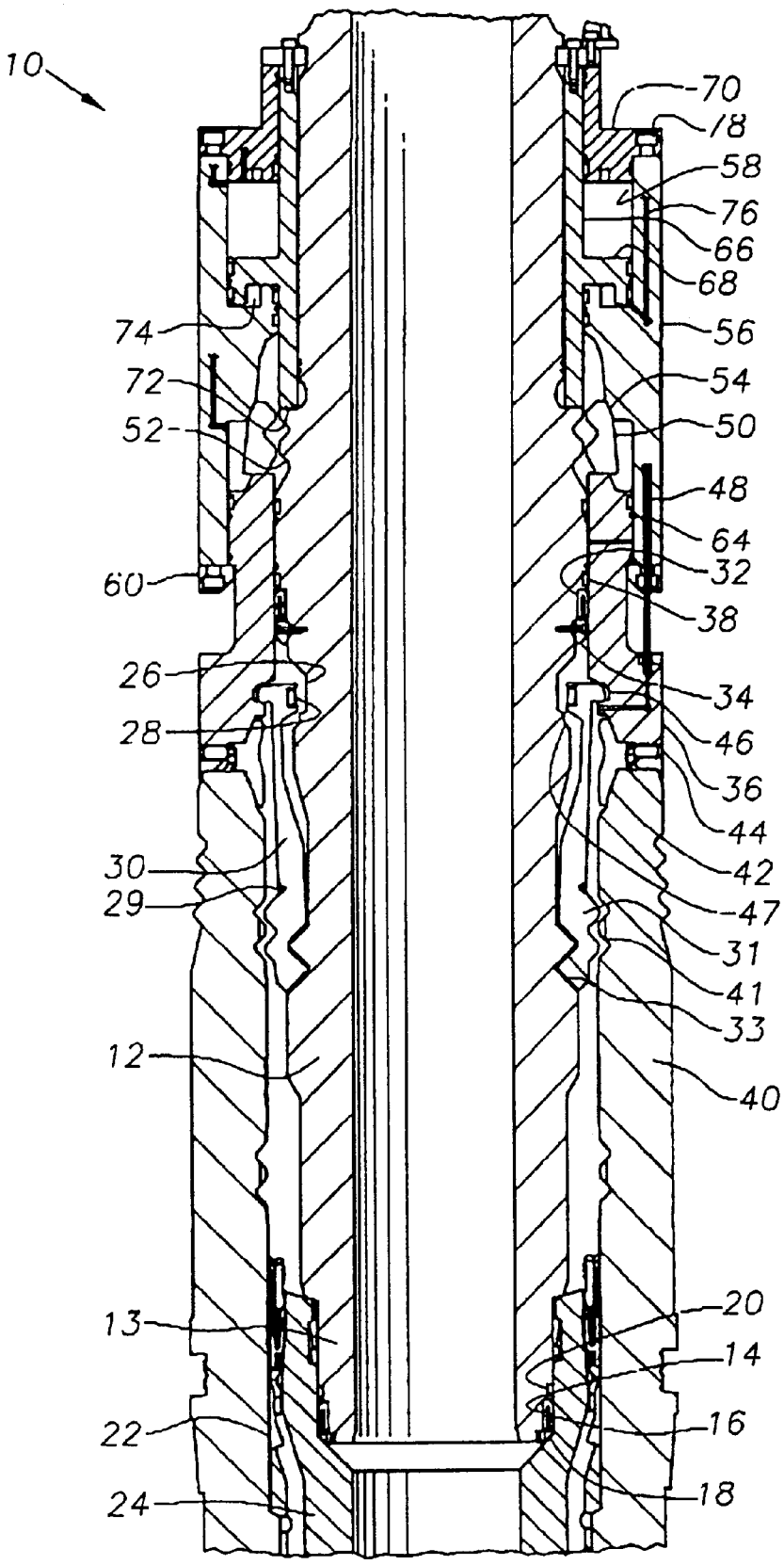
FIG. 1 is a sectional view of a tieback connector constructed in accordance with this invention, prior to pre-load.
Figure 2:
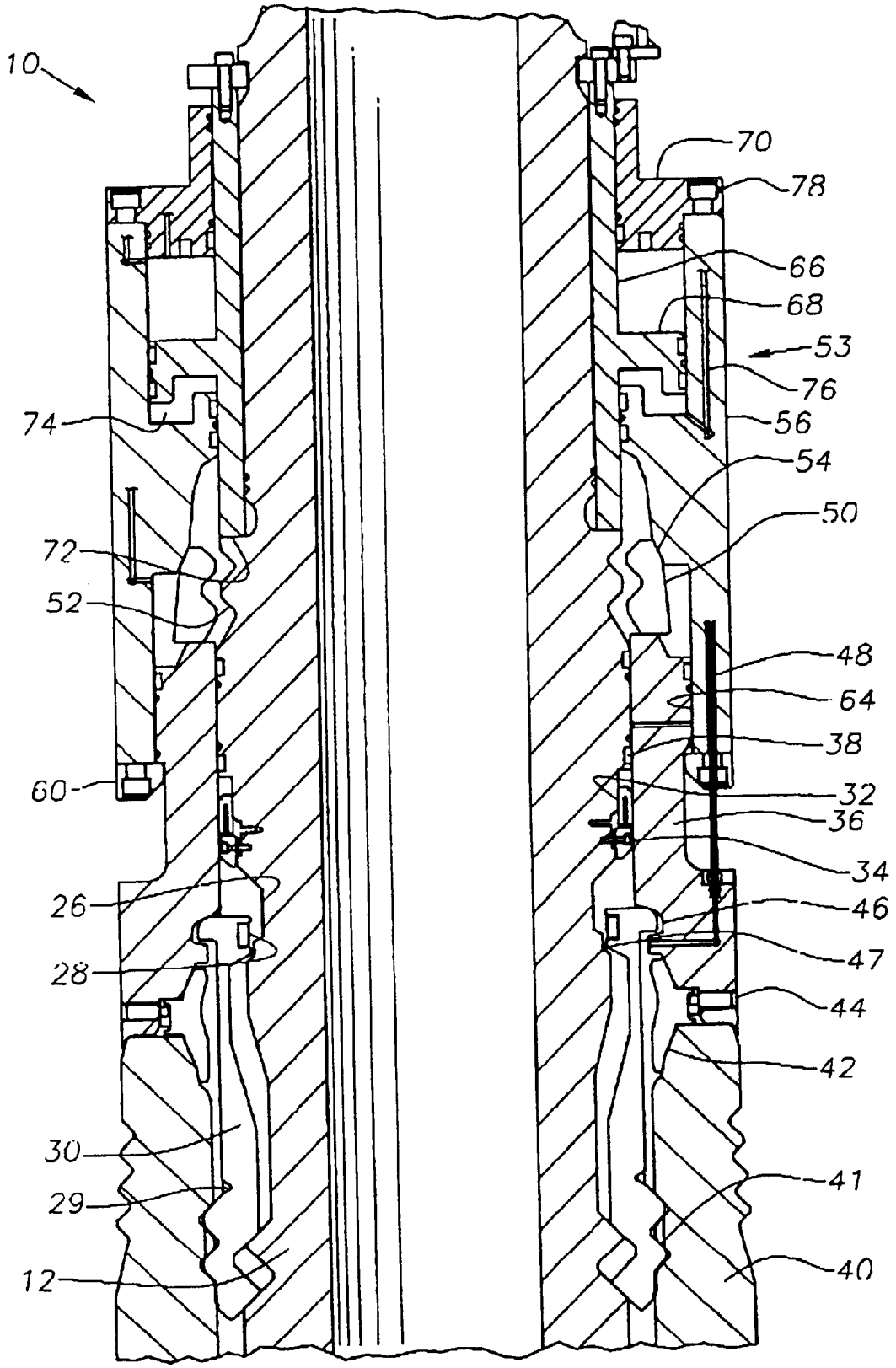
FIG. 2 is the tieback connector of FIG. 1 during setting.
Figure 3:
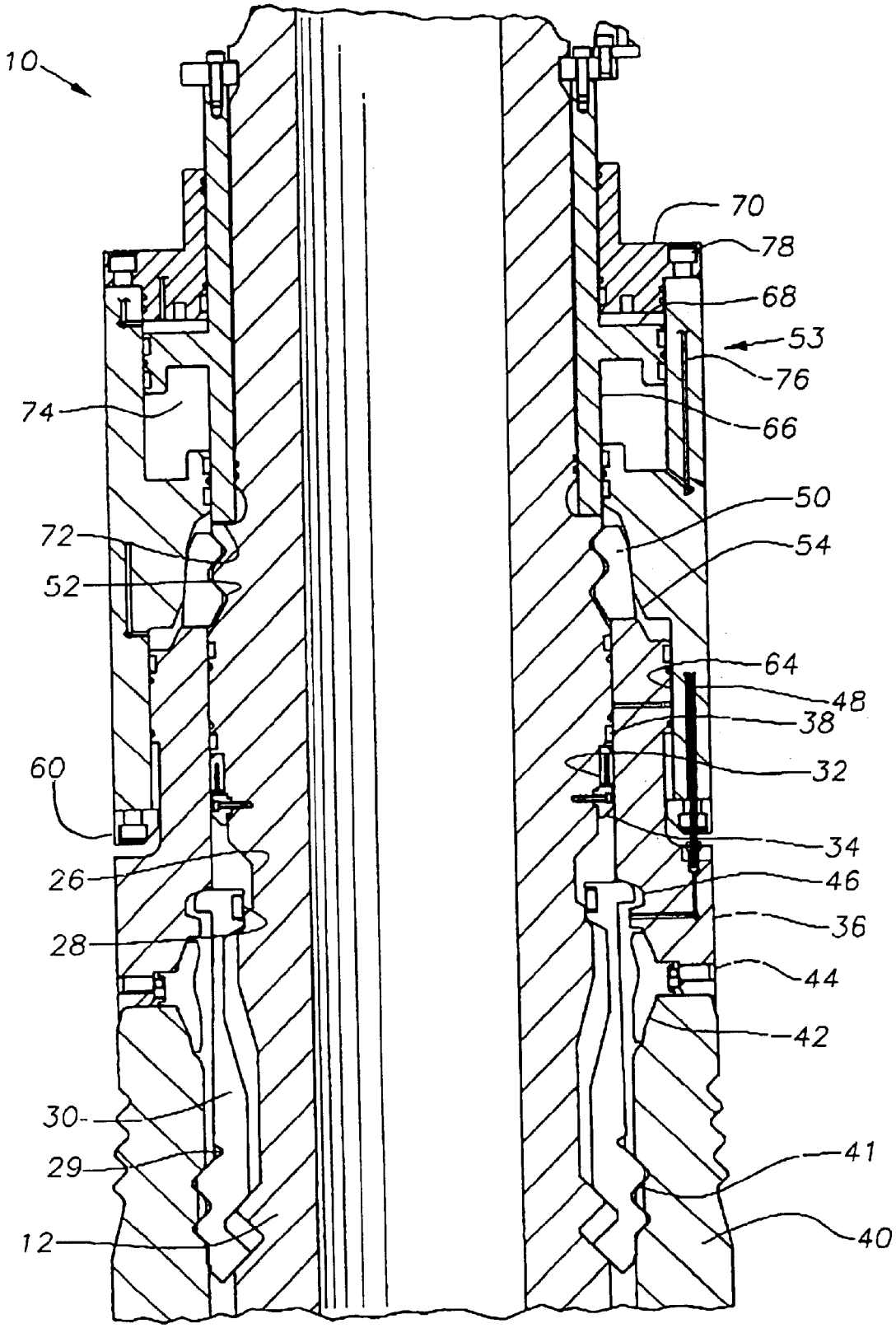
FIG. 3 is the tieback connector of FIG. 1 after final setting.

Referring to FIGS. 1–3, shown is an assembly layout of the internal tieback connector 10. A mandrel or inner body 12 has an upper end secured to a riser stress joint (not shown). The inner body 12 extends just below the tapered portion of the stress joint. At the bottom of the inner body 12 is a stinger 13 with a metal U-seal or wellhead housing seal 14 with an associated spacer 16 and nose piece 18 that retain the housing seal 14. A backup polypack seal 20 is also incorporated just above the metal U-seal 14. These seals are designed to engage and form a seal in the bowl or neck section 22 of the casing hanger 24.

About a third of the way from the bottom of the inner body 12, a groove 26 is provided in the outer surface of the inner body 12. A plurality of latch members 30 each having a load transfer portion 31 are carried about the inner body 12 with the load transfer portion in sliding engagement with the load shoulder 33. A split latch ring or retainer 28 locates in a groove in the upper end of latch member 30 to retain latch member 30. Retainer 28 urges the upper ends of latch members 30 outward. A lower split ring 29 urges the latch members 30 inward into load shoulder 33.

An upper metal U-seal 32 is attached to the inner body 12, just above the latch ring 28, and held in place by a seal retainer 34. Upper metal U-seal 32 is used to provide a seal to a housing 36 of the tieback connector 10. A backup polypack 38 is provided at this location also. This housing 36 lands on the rim of the high pressure wellhead housing or outer housing 40 where compressive load from both external loads and pre-load are transferred back into the outer housing 40. Housing 36 also provides a metal seal to the outer housing 40 through the use of a metal VX or VT gasket 42. Outer housing 40 has internal grooves 41 for engaging a profile on latch members 30. Seal 42 is retained by a set of set screw type retainers 44. The housing 36 also has an internal groove 46 for retaining latch members 30. Split ring 28 urges upper ends of latch members 30 into groove 46. Inner body 12 has a shoulder 47 slightly below the heads of latch member 30. The housing 36 also contains a test port 48 for pressure testing the annulus between the inner body 12 and outer wellhead housing 40.

An upper lock member, for example a plurality of dogs 50, is used to engage and pre-load the inner body 12 and housing 36 to the wellhead hanger 24. Dogs 50 sit on top of the housing 36 and engage a grooved profile 52 on the exterior of inner body 12 when forced inward. When the dogs 50 are out of engagement with the grooved profile 52, they reside slightly above profile 52. The tapered surfaces between dogs 50 and inner body 12 provide an axial force between the dogs 50 and the inner housing 12 when the dogs 50 are forced into the groove 52. The axial load of the dogs 50 is transferred into the top of the wellhead housing 40. At the same time, the load on the inner body 12 from the dogs 50 tries to pull the inner body 12 up, where it will be eventually reacted into wellhead housing 40 through the latch members 30.

The dogs 50 are actuated (forced radially inward) by a cam ring 54 that is integrated into a cam sleeve 56 with a cylindrical bore 58. Cam sleeve 56 is attached to the housing 36 through a split capture ring 60, located at the bottom of cam sleeve 56. The lower portion of the cam sleeve 56 extends over housing 36. Elastomeric seals 64 are provided between the interfaces of the housing 36 and both inner body 12 and cam sleeve 56. A piston 68 is reciprocally carried in bore 58. Piston 68 has a hub 66 rigidly secured to inner body 12. A top plate 70 is bolted to the top of cam sleeve 56 and slidingly engaged by piston 68. A chamber 74 is formed between the cam sleeve 56 and piston 68.

Hydraulic actuation fluid is provided to chamber 74 below piston 68 through a series of ports 76 through the cam sleeve 56 and top plate 70. Ports 76 are hydraulically connected to ROV operated valves (not shown) on the top plate 70. The ROV operated valves are used to select the hydraulic function to be performed. The valves are hydraulically connected to a ROV hydraulic hot stab (not shown) for application of the actuation fluid. This hot stab is also mounted on top plate 70, and moves with it as do the ROV operated valves during actuation.

In case mechanical override becomes necessary, two release eyelets (not shown) are provided for attachment of lifting lines. These eyelets are attached to the top plate 70 so that they can pick up on the cam sleeve 56 to free dogs 50. Secondary lock downs can be provided by providing vertical screws (not shown) that run through top plate 70 and onto the piston 68. These can be incorporated with ROV friendly T-handles.

Sequenced FIGS. 1–3 show the operation of the tieback connector 10 being engaged and pre-loaded into the high pressure wellhead housing or outer housing 40. Release of the connector 10 is in reverse operation of engagement.

Tieback connector 10 is run downward while in the position shown in FIG. 1. Dogs 50 are out of engagement with groove 52. Profile 31 of latch members 30 are in engagement with inner body load shoulder 33. This retains the connector 10 in the released condition for stabbing into the wellhead. The connector 10 is lowered into the outer housing 40. When the metal U-seal 14 reaches the casing hanger, 10,000–15,000 lbs. of force is typically required to insert metal U-seal 14. This force is provided by the weight of the tieback connector 1O and stress joint.

The tieback connector 10 will eventually land on the top of wellhead housing 40 as shown in FIG. 1. In this condition, the latch members 30 are positioned such that they are aligned within groove 26 in inner body 12. Cam ring 54 in this condition is up, allowing the lock dogs 50 to remain out.

Hydraulic pressure is then applied to the chamber 74 below piston 68. This causes cam ring 54 to travel down relative to piston 68. As shown in FIG. 3, this results in dogs 50 being pushed into groove 52, urging housing 36 more tightly against wellhead housing 40. At the same time, inner body 12 is forced up relative to wellhead housing 40 and housing 36. Latch members 30 do not move axially because they are carried within groove 46. Upward movement of inner body 12 also causes profile 31 of latch members 30 to be pushed by load shoulder 33 into grooves 41 in outer housing 40, latching the inner body 12 to the outer housing 40.

Also, as the cam ring 54 travels down, dogs 50 are forced into the mating groove 52 of the inner body 12. The taper on dogs 50 and groove 52 exert a downward force on the housing 36, which acts on the top of the wellhead housing 40 and seal 42. This downward force is reacted by the upward force on the inner body 12, producing a high pre-load force between the wellhead housing 40 and tieback connector 10. The VX gasket 42 is also seated in this operation. The VX gasket 42, along with the upper U-seal 32, provides a seal for the annulus between the outer housing 40 and inner body 12. This set position is shown in FIG. 3. Pressure can be locked in the actuation chamber 74 and a set of secondary lock screws can be run in. Annulus pressure may be monitored at any time after locking the connector on by inserting the monitor stab and opening the pressure test port valve. It is recommended that the annulus valve (not shown) be open during running to prevent a pressure lock. The valve is closed after testing.

Release of the connector is achieved by releasing pressure from the lower side of chamber 74 while applying pressure to bore 58 above piston 68 after release of any secondary locking device. This raises cam sleeve 56 and cam ring 54 relative to inner body 12, allowing lock dogs 50 to move out, freeing the inner body 12 from the dogs 50. Capture ring 60, on the lower end of cam sleeve 56, lifts the housing 36. This action allows the inner body 12 to drop back down, freeing latch members 30. The latch members 30 can now swing back into the position shown in FIG. 1, allowing the connector to be pulled free of the outer housing 40.

The invention has many significant advantages. Because the connector engages internal grooves on the wellhead, rather than external grooves, the connector can have a relatively small outer diameter that is the same size or only slightly larger than the high pressure wellhead housing. Thus, smaller openings are required in the spar air cans and keel opening to pass this connector through. Furthermore, the forgings required to build the connector can be smaller and are thus less expensive than larger connectors. The connector provides its own stabbing force by using the weight of the riser. Further pre-load can be applied hydraulicly by an ROV. Thus, the connector of this invention can achieve higher pre-load than other conventional internal connectors and reach separation capacities of some of the larger external connectors.

While the invention has been shown in only one of its forms, it should be apparent to those skilled in the art that it is not so limited, but is susceptible to various changes without departing from the scope of the invention.

We claim:

1. A connector for tying back a riser from a platform to a subsea wellhead housing, said wellhead housing having a bore with an internal groove thereon, said connector comprising:

an inner body adapted to be secured to said riser, said inner body having an external profile and a load shoulder spaced below;

a housing moveably carried on said inner body, for landing on said wellhead;

an upper lock member carried by said housing, said upper lock member being inwardly radially moveable to engage said profile, said profile being configured to move said inner body upward relative to said housing when engaged by said upper lock member;

a cam sleeve carried on said inner body for axial movement relative to said inner body forcing said upper lock member inward into engagement with said profile on said inner body; and a latch member with a load transferring portion carried on said inner body in sliding engagement with said load shoulder, said load transfer portion adapted to move radially outward and engage said internal groove when said inner body and said load shoulder are moved upward relative to said housing.

2. The connector according to claim 1 further comprising a piston member which cooperates with said cam sleeve to define a hydraulic fluid chamber adapted to receive hydraulic fluid pressure to stroke said cam sleeve axially.

3. The connector according to claim 1 wherein said external profile comprises a downward facing inclined shoulder.

4. The connector according to claim 1 wherein said lock member comprises a plurality of dogs.

5. The connector according to claim 1 wherein said housing has substantially the same outer diameter as said wellhead housing and lands on a rim of said wellhead housing.

6. The connector according to claim 1 wherein said latch member comprises a plurality of fingers, each having a finger which extends upwardly from said load transfer portion, said finger has an outer protruding portion on an upper end that engages a recess in said housing.

7. The connector according to claim 1 wherein a stinger on a lower end of said inner body is adapted to engage a bowl of a casing hanger in said wellhead housing.

8. The connector according to claim 1 wherein said lock member has a surface which bears downwardly on said housing as said cam sleeve moves axially to exert a pre-load force on said wellhead.

9. In an offshore well having a subsea wellhead that has a bore with an internal groove, a riser that connects to the wellhead and extends to a platform, an improved connector for connecting the riser to the wellhead comprising:

an inner body secured to said riser, said inner body having an external profile and a load shoulder spaced below;

a housing moveably carried on said inner body and landed in said wellhead;

an upper lock member carried by said housing, said upper lock member being inwardly radially moveable to engage said profile, said profile being configured to move said inner body upward relative to said housing when engaged by said upper lock member;

a cam sleeve carried on said inner body for axial movement relative to said inner body forcing said lock member inward into engagement with said profile on said inner body and forcing said lock member to bear downwardly on said housing exerting a pre-load force on said wellhead;

a piston member which cooperates with said cam sleeve to define a hydraulic fluid chamber adapted to receive hydraulic fluid pressure to stroke said cam sleeve axially; and a plurality of latch fingers carried on said inner body each having a load transferring portion in sliding engagement with said load shoulder and having a finger which extends upwardly from said load transfer portion, said finger has an upper end which extends above said wellhead housing and an outer protruding portion that engages a recess in said housing, said load transfer portion adapted to move radially outward and engage said internal groove when said inner body and said load shoulder is moved upward relative to said housing.

10. A method of tying back a riser from a platform to a subsea wellhead, said wellhead having a bore with an internal groove, comprising the steps of:

providing a connector having an inner body, a housing axially moveably carried on said inner body, and a latch member mounted for axial sliding movement on an inclined load shoulder on said inner body;

connecting said inner body to said riser and lowering said connector onto said wellhead such that said inner body extends into said bore and said housing lands on said wellhead; and moving said inner body upward relative to said housing to an upper position while restraining upward movement of said latch member, causing said latch member to slide radially outward on said load shoulder and engage said groove in said wellhead preventing further upward movement of said inner body, while applying a downward force on said housing against said wellhead and locking said inner body in said upper position.

11. The method according to claim 10 wherein as said inner body is moved upward and downward force is applied on said housing with hydraulic pressure in a chamber between said inner body and said housing.

12. The method according to claim 10 wherein locking said inner body in said upper position comprises pushing a lock member carried by said housing radially inward into a profile on said inner body.

13. The method according to claim 12 wherein said lock member is pushed radially inward by moving a cam sleeve axially.

14. The method according to claim 10 further comprising inserting a stinger portion on a lower end of said inner body into a bowl of a casing hanger in said wellhead.

15. A connector for tying back a riser from a platform to a subsea wellhead housing, said wellhead having a bore with an internal groove thereon, said connector comprising:

an inner body adapted to be secured to said riser;

a housing carried on said inner body, for landing on said wellhead, said inner body axially moveable relative to said housing to an upper position;

a latch member carried by said inner body that latches between said inner body and said wellhead when said inner body moves to said upper position; and a lock member that locks between said inner body and said housing when said inner body moves up, for holding said inner body in an upper position.

16. The connector according to claim 15 further comprising a stinger on a lower end of said inner body adapted to engage a bowl of a casing hanger in said wellhead.

17. A connector for tying back a riser from a platform to a subsea wellhead housing, said wellhead having a bore with an internal groove thereon, said connector comprising:

an inner body adapted to be secured to said riser;

a housing carried on said inner body, for landing on said wellhead, said inner body axially moveable relative to said housing to an upper position;

a latch member carried by said inner body that latches between said inner body and said wellhead when said inner body moves to said upper position;

a lock member that locks between said inner body and said housing when said inner body moves up, for holding said inner body in an upper position; and a cam sleeve carried on said inner body;

wherein said cam sleeve wedges said lock member between said inner body and said housing.

* * * * *